US011008205B2

(12) United States Patent
Peirsman et al.

(10) Patent No.: US 11,008,205 B2
(45) Date of Patent: May 18, 2021

(54) DISPENSING APPARATUS PROVIDED WITH A COOLING UNIT

(71) Applicant: Anheuser-Busch InBev S.A., Brussels (BE)

(72) Inventors: Daniel Peirsman, Leuven (BE); Lieven Dirx, Leuven (BE)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 16/465,129

(22) PCT Filed: Nov. 29, 2017

(86) PCT No.: PCT/EP2017/080778

§ 371 (c)(1),
(2) Date: May 29, 2019

(87) PCT Pub. No.: WO2018/099947

PCT Pub. Date: Jun. 7, 2018

(65) Prior Publication Data

US 2019/0322517 A1 Oct. 24, 2019

(30) Foreign Application Priority Data

Nov. 30, 2016 (EP) ..... 16201501

(51) Int. Cl.

| | |
|---|---|
| ***B67D 1/08*** | (2006.01) |
| ***B67D 1/00*** | (2006.01) |
| ***F25D 31/00*** | (2006.01) |

(52) U.S. Cl.

CPC ..... *B67D 1/0862* (2013.01); *B67D 1/0042* (2013.01); *B67D 1/0869* (2013.01); *F25D 31/002* (2013.01); *B67D 2210/00034* (2013.01)

(58) Field of Classification Search

CPC .. B67D 1/0862; B67D 1/0869; B67D 1/0042; B67D 1/0857; B67D 2210/00034; F25D 31/002

See application file for complete search history.

(56) References Cited

U.S. PATENT DOCUMENTS 4,829,771 A * 5/1989 Koslow ..... B67D 1/0869 62/3.64

5,634,343 A 6/1997 Baker, III (Continued)

FOREIGN PATENT DOCUMENTS

| | | |
|---|---|---|
| DE | 34 46 383 | 7/1985 |
| DE | 102006005381 | 7/2006 |

(Continued)

*Primary Examiner* — J C Jacyna

(74) *Attorney, Agent, or Firm* — Levy & Grandinetti

(57) ABSTRACT

A cooling unit has (a) a cooling cartridge having (i) two foils sealed to one another along a perimeter area delimiting an inner area of the cartridge where a liquid pathway is defined between both foils, the liquid pathway making a fluid communication between an inlet and an outlet of the cooling cartridge; (ii) a web or mesh of material provided between both foils in the inner area of the cooling cartridge in the liquid pathway, the web or mesh of material has contact zones where the foils contact the web or mesh of material in the inner area of the cooling cartridge when the pressure reigning in the inner area equals ambient pressure; (b) a first cooling plate has a first surface and a second cooling plate has a second surface facing the first surface; (c) a cold source suitable for cooling said first and second surfaces, wherein the inner area of the cooling cartridge is positioned between both cooling surfaces; wherein the foils are not or only at distinct locations attached to the contact zones of the web or mesh material.

16 Claims, 7 Drawing Sheets

(56) References Cited

U.S. PATENT DOCUMENTS

| | | | | |
|---|---|---|---|---|
| 6,658,859 | B2 | 12/2003 | Phelps et al. | |
| 2003/0188540 | A1* | 10/2003 | Van Winkle | F25B 21/02 62/3.64 |
| 2004/0050532 | A1* | 3/2004 | Yamaguchi | F24S 10/506 165/46 |
| 2014/0124187 | A1* | 5/2014 | Albalat | F28F 21/08 165/185 |
| 2016/0060089 | A1* | 3/2016 | Netter | B67D 1/0869 222/82 |
| 2018/0105410 | A1* | 4/2018 | Kim | B67D 3/0061 |
| 2018/0306471 | A1* | 10/2018 | Wasserman | F25D 31/002 |

FOREIGN PATENT DOCUMENTS

| | | |
|---|---|---|
| EP | 1 188 995 | 3/2002 |
| EP | 1 642 863 | 4/2006 |
| EP | 2 103 565 | 9/2009 |
| JP | 2002-46799 | 2/2002 |
| WO | WO 87/07361 | 12/1987 |
| WO | WO 2004/051163 | 6/2004 |
| WO | WO 2007/076584 | 7/2007 |
| WO | WO 2010/064191 | 6/2010 |
| WO | WO 2013/013059 | 1/2013 |

* cited by examiner

DISPENSING APPARATUS PROVIDED WITH A COOLING UNIT

TECHNICAL FIELD

The present invention concerns a dispensing apparatus for domestic use or of the type found in pubs and bars for dispensing a liquid, typically a beverage such as a beer or other carbonated beverages which are to be served at a low temperature. In particular, the dispensing apparatus of the present invention is provided with a cooling cartridge which can be engaged into a cooling unit and thus form a section of a dispensing tube which is in thermal contact with cooling plates mounted in the cooling unit.

BACKGROUND OF THE INVENTION

Many applications require the cooling of a liquid. In particular, beverages or beverage components must often be cooled prior to or upon dispensing. This is the case for dispensing malt based beverages, such as beer, or any soda. There are basically two ways of serving a beverage at a temperature substantially lower than room temperature: either a whole container or reservoir containing the beverage or a component thereof to be dispensed is cooled, or only the volume of beverage or beverage component flowing through a dispensing tube from the container or reservoir to a tapping valve is cooled.

Many beverage dispensers comprise a cooled compartment for storing and cooling a container or reservoir. A common cooling system is based on the compression-expansion of a refrigerant gas of the type used in household refrigerators. Thermoelectric cooling systems using the Peltier effect have also been proposed in the art for cooling a container stored in a dispensing apparatus. One disadvantage of cooling the whole container/reservoir is that when an empty container must be replaced by a new one or when a reservoir needs to be refilled, it takes considerable time to bring the content of the new container or refilled reservoir down to the desired low temperature. A solution to this problem is of course to constantly store a full container in a cooled compartment so that it can be used immediately after being loaded into a dispensing apparatus in replacement of an empty container. This solution, however, requires the investment of an additional cooling compartment for storing cooled containers in the wait of being loaded, and requires extra work to store a new container into the cooled compartment after having loaded a new cooled container onto the dispensing apparatus.

Cooling only the volume of beverage flowing through the dispensing tube clearly has many potential advantages: no need to pre-cool a container in reserve as discussed supra, the volume of liquid being cooled is restricted to the volume being dispensed or even less, etc. These advantages are, however, difficult to attain, because of the numerous challenges of such process. It must be taken into consideration that the dispensing tube must be cleaned or changed at regular intervals, either because the type of beverage (type of beer) changes from one container to the other, or because with time bacterial deposits may form in a dispensing tube. Another challenge is that beer must be dispensed at a relatively high flow rate, of typically 2 oz/s or 3.5 l/min, and it is difficult to extract all the thermal energy required to bring the temperature of the beverage to the desired value at such flow rates.

Traditionally, the dispensing tube of a dispensing apparatus bringing in fluid communication the interior of a container/reservoir with a tapping valve comprises a serpentine or coil dipped into a vessel of iced water or any other secondary refrigerant such as glycol. Although simple and efficient, this solution has several drawbacks. A vessel of iced water occupies a substantial space which is often scarce behind a bar counter or at home. The temperature of the iced water is limited to zero degree Celsius (0° C.). The level of ice and water must be controlled and ice refilled at regular intervals. A compressor can be used to form ice, so that the vessel needs not be refilled. Subzero temperatures can be reached with e.g., glycol. Furthermore, the coil or serpentine is usually made of copper or other heat conductive metal and must be cleaned at regular intervals, which is not easy in view of the coiled geometry of the serpentine.

The dispensing tube used for dispensing beverage out of the container may be cooled by contacting it with cooling systems using the Peltier effect. Although not as efficient as other cooing systems, thermoelectric cooling systems have the great advantage of not requiring any refrigerant gas, nor any source of cold refrigerant liquid and only require to be plugged to a source of power. Examples of beverage dispensing apparatuses comprising a thermoelectric cooling system are disclosed in EP1188995, EP2103565, DE102006005381, U.S. Pat. Nos. 6,658,859, 5,634,343, WO2007076584, WO8707361, WO2004051163, EP1642863. For example, a dispensing apparatus comprising a Peltier or thermoelectric cooling system for cooling a section of a dispensing tube is disclosed, e.g., in WO2010064191. A dispensing tube comprises a section of deformable walls disposed in a passage extending through a cooling block cooled by a Peltier cooling system. The deformability of the material of the disposable tube is such that the outer surface of the wall of the tube abuts against the inner surface of said passage when the beverage is pressurized. This ensures a better thermal contact between the cooling block and the dispensing tube. The passage through the cooling blocks comprises successive chambers separated from one another by thin passages. The thermal contact area between the dispensing tube and the cooling block is quite reduced and it seems unlikely that satisfactory results could be obtained at low rates of the order of 3.5 l/min. This is probably the reason why this cooling system is described with respect to domestic beverage dispensing devices only, which function at lower flow rates than in pubs and bars.

Other cooling solutions have been proposed in the art to cool beer flowing through a dispensing tube. For example, JP2002046799 discloses a domestic beverage dispensing device comprising a detachable cooling means placed in tight contact with a flexible dispensing tube, so as to allow the beer supplied from the barrel to be cooled and supplied at an appropriate temperature. The cooling means comprises a gelatinous cold-insulation agent filled in a predetermined container. In addition, a wall surface of the cooling member is formed with a guide for placing the flexible dispensing tube.

There therefore remains a need for a cooling system suitable for cooling beer flowing through a dispensing tube at high rates as used in pubs and bars or for small cooling units suitable for instant cooling of beverages or beverage components in domestic apparatuses. The present invention proposes a solution to this need, with a user friendly system, requiring no skills to install and of easy maintenance. These and other advantages of the present invention are presented in continuation.

SUMMARY OF THE INVENTION

The present invention is defined in the appended independent claims. Preferred embodiments are defined in the dependent claims. In particular, the present invention concerns a cooling unit for a beverage dispensing apparatus, comprising:

1. A cooling unit comprising:
   (a) a cooling cartridge having:
      (i) two foils sealed to one another along a perimeter area delimiting an inner area of the cartridge where a liquid pathway is defined between both foils, the liquid pathway making a fluid communication between an inlet and an outlet of the cooling cartridge;
      (ii) a web or mesh of material provided between both foils in the inner area of the cooling cartridge in the liquid pathway, the web or mesh of material comprising contact zones where the foils contact the web or mesh of material in the inner area of the cooling cartridge when the pressure reigning in the inner area equals ambient pressure;
   (b) a first cooling plate comprising a first surface and a second cooling plate comprising a second surface facing the first surface;
   (c) a cold source suitable for cooling said first and second surfaces, wherein the inner area of the cooling cartridge is positioned between both cooling surfaces;

characterized in that the foils are not or only at distinct locations attached to the contact zones of the web or mesh material.

Preferably the web or mesh of material disposed between both foils defining a non-rectilinear trajectory to the liquid pathway.

The web or mesh of material disposed between both foils comprising a perimeter wall defining the perimeter of the cooling cartridge with both foils sealed to the perimeter wall, the web or mesh extending in the inner area defining a non-rectilinear trajectory of the liquid pathway between the foils.

In a preferred embodiment, the part of the foils situated in the inner area is stretchable or has dimensions larger than the inner area, such as to allow that the foils are at least locally spaced apart from the contact zones wall parts in a direction perpendicular to the cooling surfaces when the inner volume of the liquid line is pressurized, thereby creating short-cuts in the trajectory of the channel in the cooling unit.

The distance separating the first surface and second surface of the first and second cooling plates can preferably be varied, from a loading distance, d0, greater than a thickness H1 of the line and forming an insertion slot allowing the introduction of the cartridge between the two cooling plates, to a cooling distance, dc<d0, wherein the first and second surfaces contact the first and second foils and press these foils against the wall parts of the web or mesh.

When spaced at a distance dc, the cooling plates preferably press the foils against the contact zones of the web or mesh.

In order to ensure a turbulent flow of the liquid to be cooled, it is preferred that baffles or turbulence inducing elements are provided in the non-rectilinear trajectory of the liquid pathway.

In order to make the cooling unit compact, it is preferred to manufacture the foils in a material having good heat transfer rates such as a metallic material, for example aluminium. The web or mesh can be made in either a polymeric material or a metallic material.

To increase the contact area between the cooling surfaces and the liquid to be cooled, it is preferred that wall parts of the web defining the contac zones are as thin as possible. Not or only at distinct points welding or glueing the foils to the wall parts of the web allows for reducing the thickness of these wall parts to 2 mm or less, preferably 1 mm or less.

The present invention also concerns a beverage dispensing apparatus comprising a cooling unit according to the present invention, such beverage dispensing apparatus can be of any type, including a domestic apparatus or an on-trade apparatus for use in eg. bars, hotels or pubs. The dispensing apparatus is preferably designed for dispensing carbonated malt-based beverages.

In a preferred embodiment, the dispensing apparatus is of a type comprising a source of a concentrated beverage component fluidly connected to a dispense tap by a first dispense line and a source of a diluent fluidly connected to the dispense tap by a second dispense line, the cooling unit integrated in the apparatus for cooling the concentrated beverage component and/or diluent when flowing to the first and/or second dispense line.

The dispensing apparatus may comprise a mixing unit having an inlet in fluid communication with the first and second dispense lines and an outlet in fluid communication with the dispense tap, in which case, the cooling unit is preferably integrated in the apparatus for cooling the concentrated beverage component and/or diluent downstream the mixing unit.

In another embodiment or in addition of a mixing unit, the dispensing apparatus may comprise a carbonation unit, preferably an in-line carbonation unit, having an inlet in fluid communication with the source of diluent and an outlet in fluid communication with the dispense tap, in which case, the cooling unit is preferably integrated in the apparatus for cooling the diluent downstream the carbonation unit.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1:
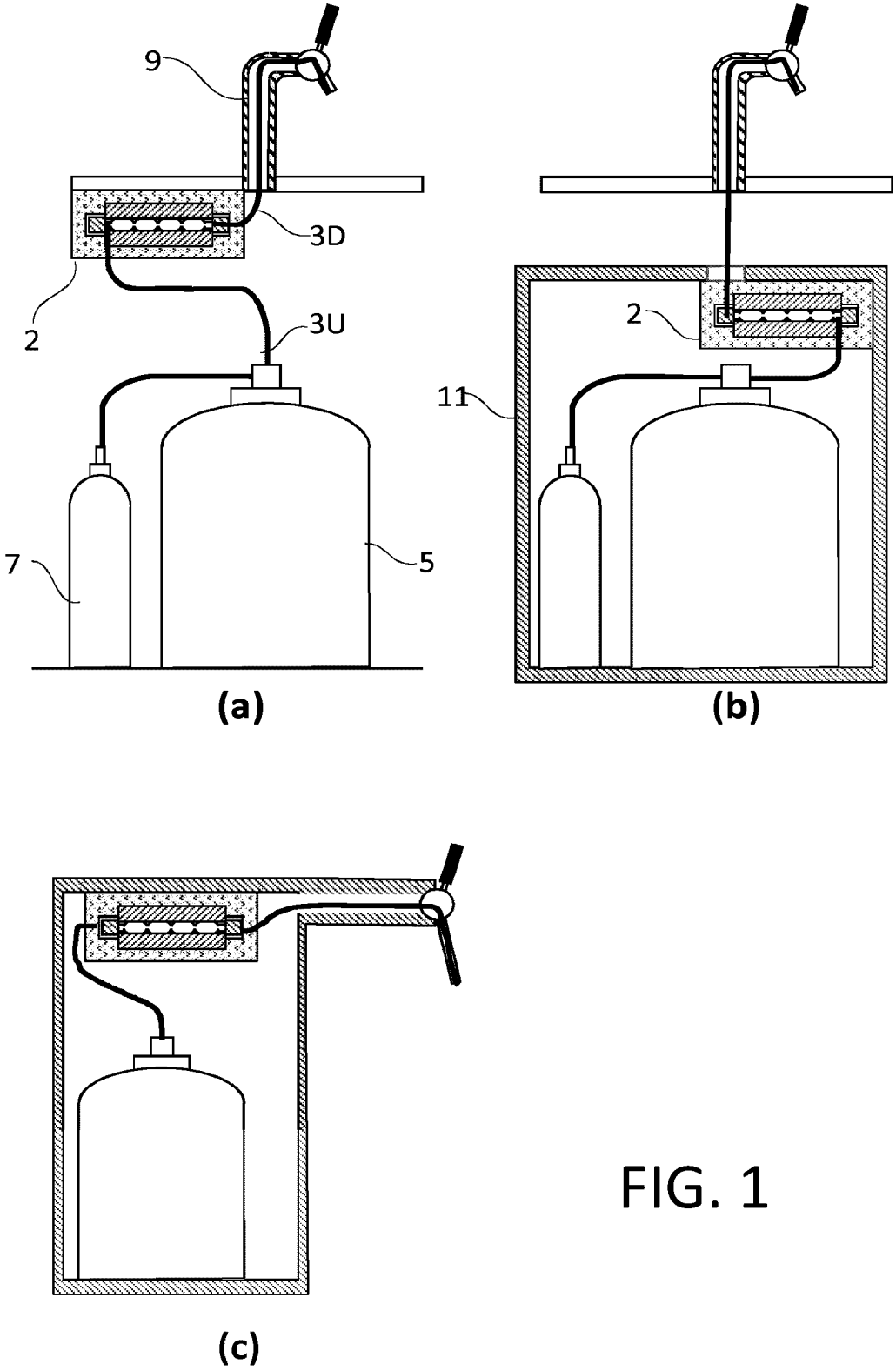
FIG. 1: shows three embodiments of dispensing apparatuses comprising a cooling unit according to the present invention.

As illustrated in FIG. 1, the present invention concerns a beverage dispensing apparatus and a kit-in-parts for forming such a beverage dispensing apparatus comprising the following elements:

- a beverage dispensing appliance provided with a cooling unit (2) comprising a slot defined by the distance separating a first and second surfaces of a first and second cooling plates (2P);
- a cartridge (1) formed by two foils (1F) and a web (1W) or mesh of material having a perimeter wall (1PW) defining the perimeter of an inner area and several wall parts (1WP) attached to the perimeter wall and extending in the inner area defining a liquid pathway (1C) having a non-rectilinear trajectory between the foils, the liquid pathway extending from a cooling unit inlet (1*i*) to a cooling unit outlet (1*o*), both the cooling unit inlet (1*i*) and cooling unit outlet (1*o*) preferably being located outside of the inner area;
- an upstream dispensing tube section (3U) coupled to or suitable for coupling, on the one hand, to a container (or reservoir) containing a beverage or beverage component and, on the other hand, to the inlet (1*i*) of the cooling unit, and
- a downstream dispensing tube (3D) coupled to or suitable for coupling, on the one hand, to the outlet (1*o*) of the cooling unit and, on the other hand, to a dispensing tap (9V), provided for example at the top of a dispensing column (9) as traditionally used in pubs.

The foregoing elements win be discussed in more details in continuation. The gist of the invention is that the foils are not or only at distinct locations attached to the wall parts or contact zones (IZ) of the web or mesh, thereby creating short-cuts in the trajectory of the channel in the cooling unit promoting a turbulent liquid flow in the cartridge and hence improving cooling efficiency of the liquid and/or allowing the web wall parts to be dimensioned to have a cross-section in the plane of the cooling surfaces that is as small as possible to increase the contact area between the liquid to be cooled and the foils and on the cooling surface, which in turn are in contact with the cooling surfaces. In other words, the footprint of the contact zones (IZ), in this case the web walls is minimized without influencing the length of the channel in the cartridge.

A liquid pathway or in this case channel can be defined by an axial direction, parallel to an axial axis, which defines the trajectory of the channel (which is not necessarily rectilinear). The axial axis often corresponds to an axis of symmetry of the channel or, for non rectilinear channels, is often defined by the succession of points of symmetry put side by side to form a continuous line. A channel is also defined by radial directions, including any direction normal to the axial axis. In a cylindrical channel, the axial axis is the axis of revolution of the cylinder and the radial directions are defined by any radius of a cross-section normal to the axial axis. In the present case, the first and second foils are not welded or glued to the web wall parts and allow as such short cuts to be created in the channel of the cartridge. The at least one radial direction along which the channel must be flexible is thus defined in use by the moving direction of the foils in view of the web wall parts.

The cooling unit comprises a cold source (2C) for cooling the first and second cooling plates. Any type of cold source known in the art can be used to cool the first and second cooling plates. Typically compressor based refrigeration systems or thermoelectric cooling systems are well suited for cooling the cooling plates. Any other method can, however, be used without departing from the present invention. The cooling unit is preferably provided with insulation material (2*i*) arranged such as to enhance heat exchange only from the first and second surfaces facing each other and designed to contact the foils of the cartridge.

Figure 2:
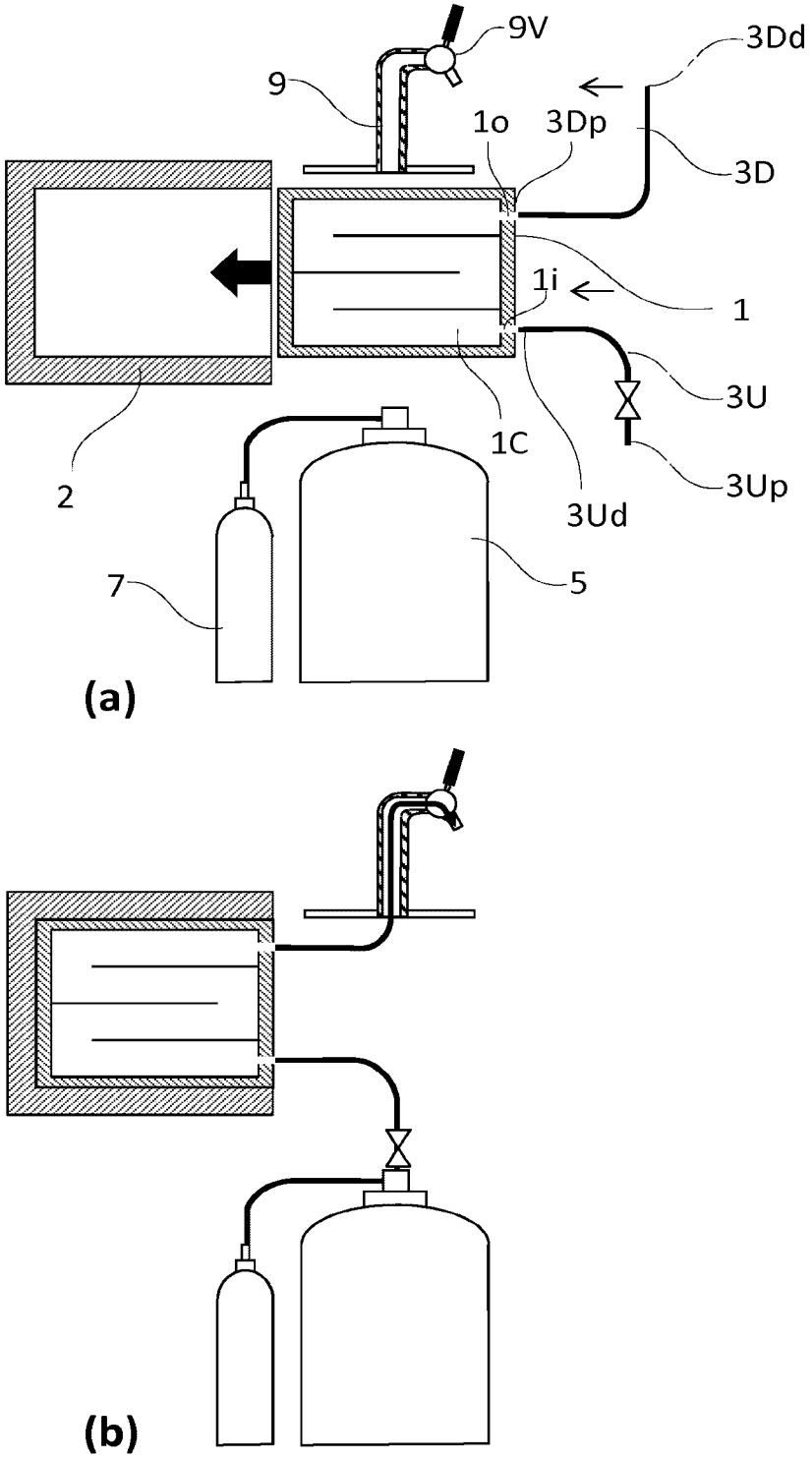
FIG. 2: shows a first embodiment of a dispensing apparatus according to the present invention (a) before insertion of the cooling cartridge into an appropriate slot, and (b) with the cooling cartridge in position.
Figure 3:
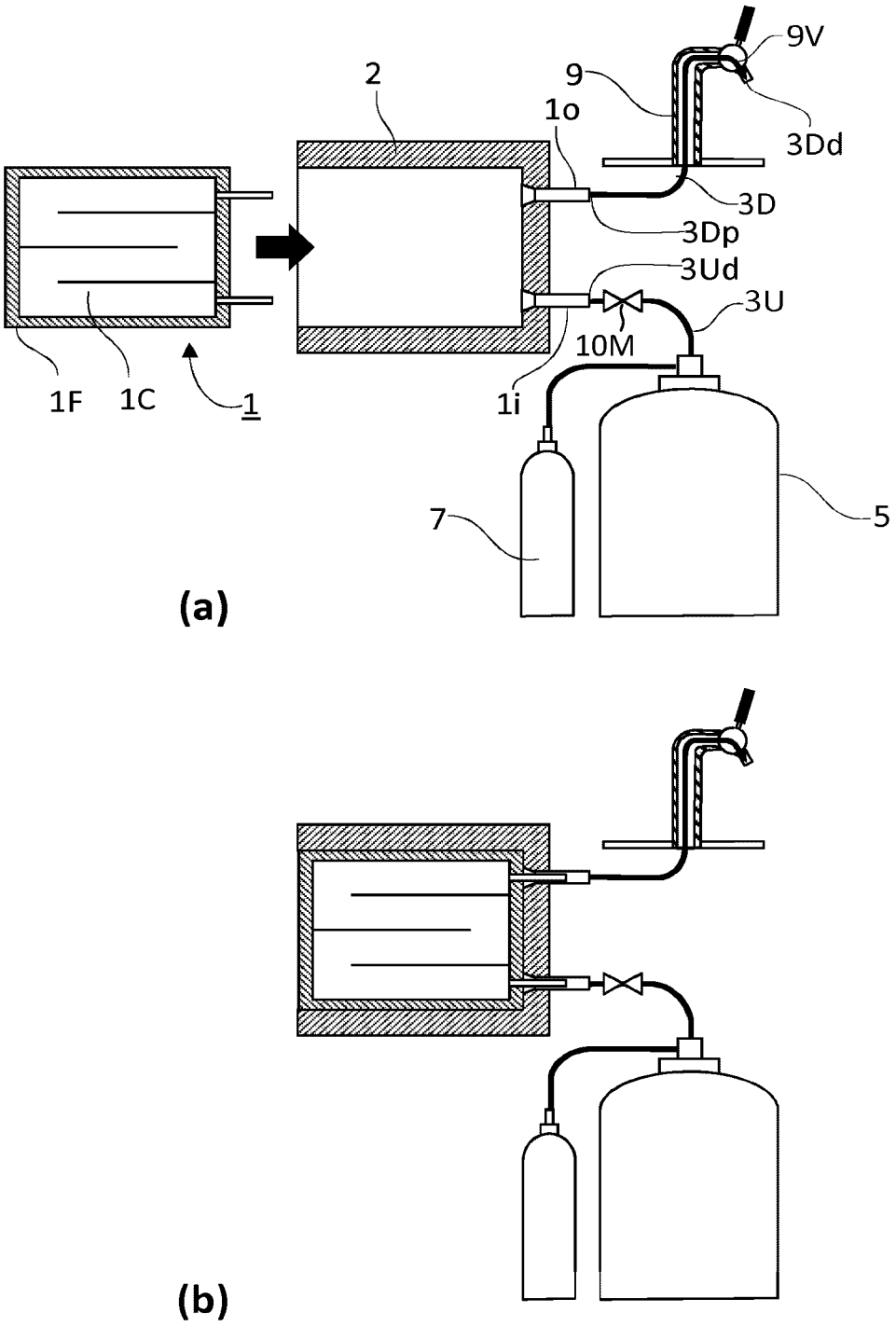
FIG. 3: shows an alternative embodiment of a dispensing apparatus according to the present invention (a) before insertion of the cooling cartridge into an appropriate slot.

As can be appreciated from FIGS. 2&3, a dispensing tube running continuously from a beverage keg, container or reservoir (5) to a dispensing tap (9V) is composed of three sections:

(a) an upstream dispensing tube section (3U) comprising an upstream proximal end (3Up) which can be coupled to the container and brought in fluid communication with the interior thereof, and an upstream distal end (3Ud) which is or can be sealingly coupled to the channel inlet (1*i*) of the cartridge;

(b) the channel of the cartridge forming a serpentine extending in a non-rectilinear trajectory from a channel inlet—coupled to or suitable for being coupled to the upstream distal end (3Ud)—to a channel outlet, and (c) a downstream dispensing tube section (3D) comprising a downstream proximal end (3Dp) coupled to or suitable for coupling to the channel outlet (1*o*), and a downstream distal end (3Dd), which can be coupled to the dispensing tap (9V).

The terms "upstream" and "downstream" are defined herein with respect to the flow direction of the beverage from a container to a tapping valve, i.e., from the upstream proximal end (3Up) to the downstream distal end (3Dd).

One or more valves may be provided in any of the foregoing three sections. At least a valve may be advantageous at the time of coupling the upstream proximal end (3Up) to the keg before the downstream distal end (3Dd) is correctly coupled to the dispensing tap (9V) and the latter is closed, to prevent undesired and uncontrolled spilling of the beverage. The valve may also be provided on the keg itself or on the coupling ring used for coupling the dispensing tube to the keg. Strictly speaking, a valve is not essential since if the downstream dispensing tube section (3D) is coupled to the dispensing tap (9V) before coupling the upstream dispensing tube section (3U) to the keg, no spilling can occur. A valve is, however, advantageous as a fool proof measure, considering that kegs in a pub may be handled by unexperienced staff or in stressful conditions of noise, crowd, hurry, etc.

For hygiene reasons, as well as for clearly separating the tastes when two kegs containing different beverages are mounted successively to a same dispensing appliance, it is preferred that when the whole dispensing tube (i.e., composed of the three sections described above) be disposable. It is therefore preferred to use materials which are cheap and recyclable.

Figure 6:
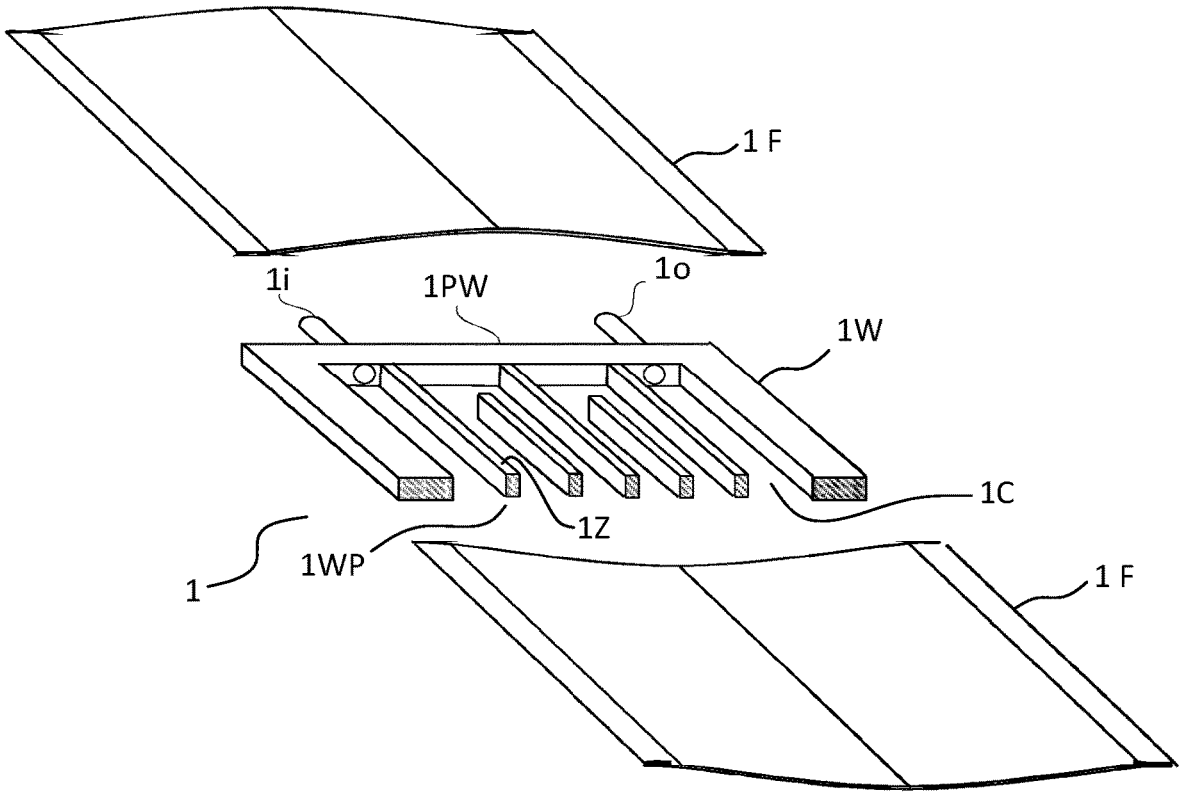
FIG. 6: shows a perspective cut view of an embodiment of a cooling cartridge.

A cartridge in accordance with the present invention is illustrated in FIG. 6. The foils (1F) (thin film material) of the cartridge are preferably slightly larger than the perimeter of the cartridge defined by the perimeter wall (1W) of the web and/or are manufactured in a stretchable material, to allow that the foils can be locally spaced apart from the web wall parts, especially when the liquid flowing through the channel is pressurised at a pressure higher than atmospheric pressure. The foils are preferably manufactured in a polymeric material or a metallic material or a metalized polymeric material such as a metallic/polymeric hybrid material having an oxygen transfer of maximally 4 cc/metre/day/bar @20° C., preferably maximally 1 cc/metre/day/bar @20° C. and most preferably maximally 0.05 cc/metre/day/bar @20° C. A suitable material is aluminium, preferably an aluminium foil with a thickness of of 80 μm or less. The web material is preferably either a polymeric material (preferably a polyolefin such as polyethylene, polypropylene, etc.) or a metallic material (preferably aluminium) or a metallic/polymeric hybrid material such as a metal coated polymeric material, with the perimeter wall providing a minimum stiffness to the cartridge. The foils can be fixed to the perimeter wall and, if desired, at some distinct points or sections to the web wall parts by welding, brazing or glueing. The web wall parts are preferably made as thin as possible to limit the area of the cartridge occupied by web material and hence to maximise the contact area of liquid to be cooled with the foils of the cartridge. Since welding, brazing or glueing of the foils to the web wall parts is optional, the thickness of the web wall parts can be limited, preferably to a thickness of 2 mm or less, preferably 1 mm or less.

In case the foils are manufactured in a metal coated polymeric material, the foils may comprise a metallic, preferably aluminum layer of at least 30 μm, preferably at least 40 μm and a polymeric, preferably polyethylene layer having a thickness preferably in a range of 10 μm to 20 μm. The metallic layer serves preferably provides for the barrier properties and the heat conductive properties of the foils, whereas the polymeric layer allows the foils to be welded to the web material.

The non-continuous fixation of the foils to the web wall parts provides two important advantages to the cooling cartridge. First, is allows for the formation of short-cuts when a pressurized fluid flows through the channel as the foils are spaced from the web wall parts and liquid flows from one section of the channel to another, thereby inducing a turbulent flow in the channel which increases cooling efficiency. Secondly, the absence of a continuous fixation allows for maximise the contact area of liquid to be cooled with the foils of the cartridge again improving cooling efficiency.

Figure 7:
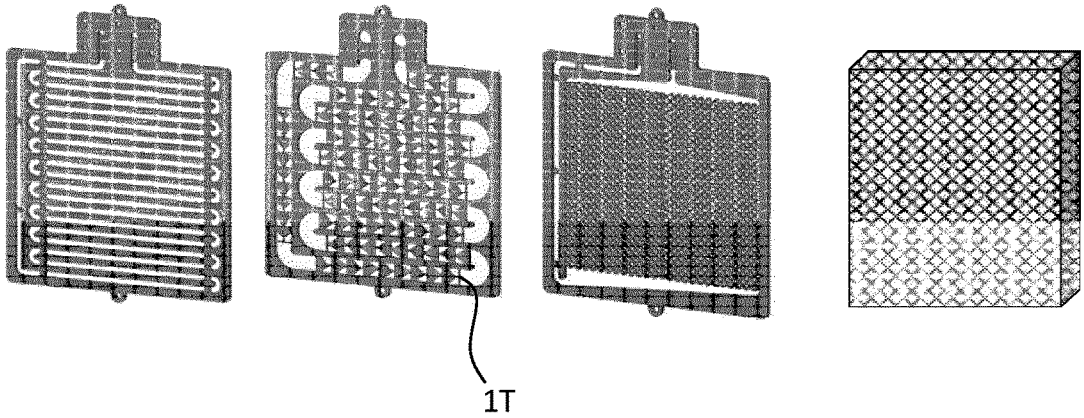
FIG. 7: shows an alternative web or mesh of a cooling cartridge according to the present invention.
Figure 8:
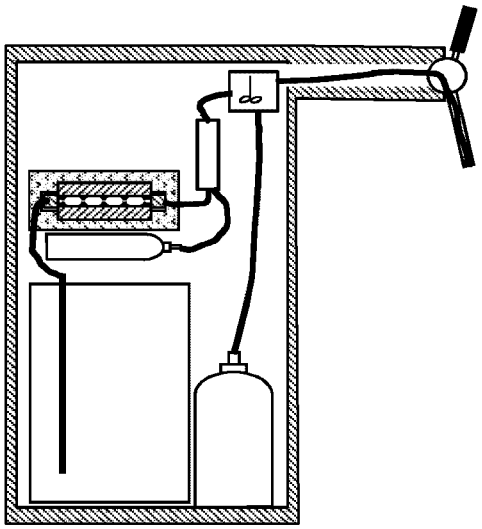
FIG. 8: shows a fourth embodiment of a dispensing apparatus comprising a cooling unit according to the present invention.

Additionally, baffles or turbulence inducing elements can be provided in the channel. As illustrated in FIG. 7. such turbulence inducing elements (1T) can be made in one piece with the web. In addition to the baffles or as an alternative for inducing high turbulence, it is also possible to design the cooling unit such that the channel has a relatively small cross section and large length and wherein the pressure in the liquid line at the inlet of the cooling unit is set rather high, creating a large pressure drop over the channel between the liquid inlet and liquid outlet to induce a high Reynolds number on the liquid flow. In the right-most example of FIG. 7, the web of material is executed as a mesh having the function of both the web of material (defining the non-rectilinear trajectory of the channel or pathway) and of the baffles. As in this case the wall parts are more difficult to define, one can define contact zones (IZ) between the foils and the mesh of material, which contact zones (IZ) are places where the foils contact the web or mesh of material in the inner area of the cooling cartridge when the pressure reigning in the inner area equals ambient pressure. In other words, the contact zones (IZ) are configured to contact the foils of the cooling cartridge when the pressure reigning in the inner area (the pressure of the liquid flowing in the liquid pathway) equals ambient (atmospheric) pressure.

In a preferred embodiment, the perimeter wall of the web is defined by four edges, including a first pair of edges which are substantially parallel to one another and a second pair of edges which are substantially parallel to one another and are preferably normal to the first pair of edges, thus defining a rectangle or square.

In one embodiment, the upstream dispensing tube section is permanently coupled to the channel inlet and, similarly, the downstream dispensing tube section is permanently coupled to the channel outlet of the cartridge. This way, a user is obliged to replace the whole dispensing tube and is not tempted to keep one or the other sections for further use, which could be detrimental to a consumer for hygienic reasons. Such an embodiment could be used in an assembly as illustrated in FIG. 2.

In an alternative embodiment, illustrated in FIG. 3, both upstream and downstream dispensing tube sections are reversibly coupled to the cooling cartridge. A cartridge is provided with channel inlet and channel outlet protruding from the perimeter wall. When the cartridge is introduced into the insertion slot defined by the two cooling plates, the inlet channel is reversibly engaged and coupled to the distal end of the upstream dispensing tube section and, similarly the channel outlet (1*o*) is reversibly coupled to the proximal end of the downstream dispensing tube section. It can be very advantageous when using kegs provided with an upstream dispensing tube section permanently coupled to said keg, as sometimes available on the market.

In a particular embodiment of the cooling unit, the first surface and second surface of the first and second cooling plates can be varied. This ensures a good contact between the channel (1C) and the cooling plates (2P) so that the heat transfer from the beverage to the cooling plates is optimized. In an embodiment illustrated in FIG. 4, the first and second cooling plates are each coupled to resilient means (2F) such as to apply a pressure thereon which tends to decrease the distance separating the first surface and second surface of the first and second cooling plates.

Figure 4:
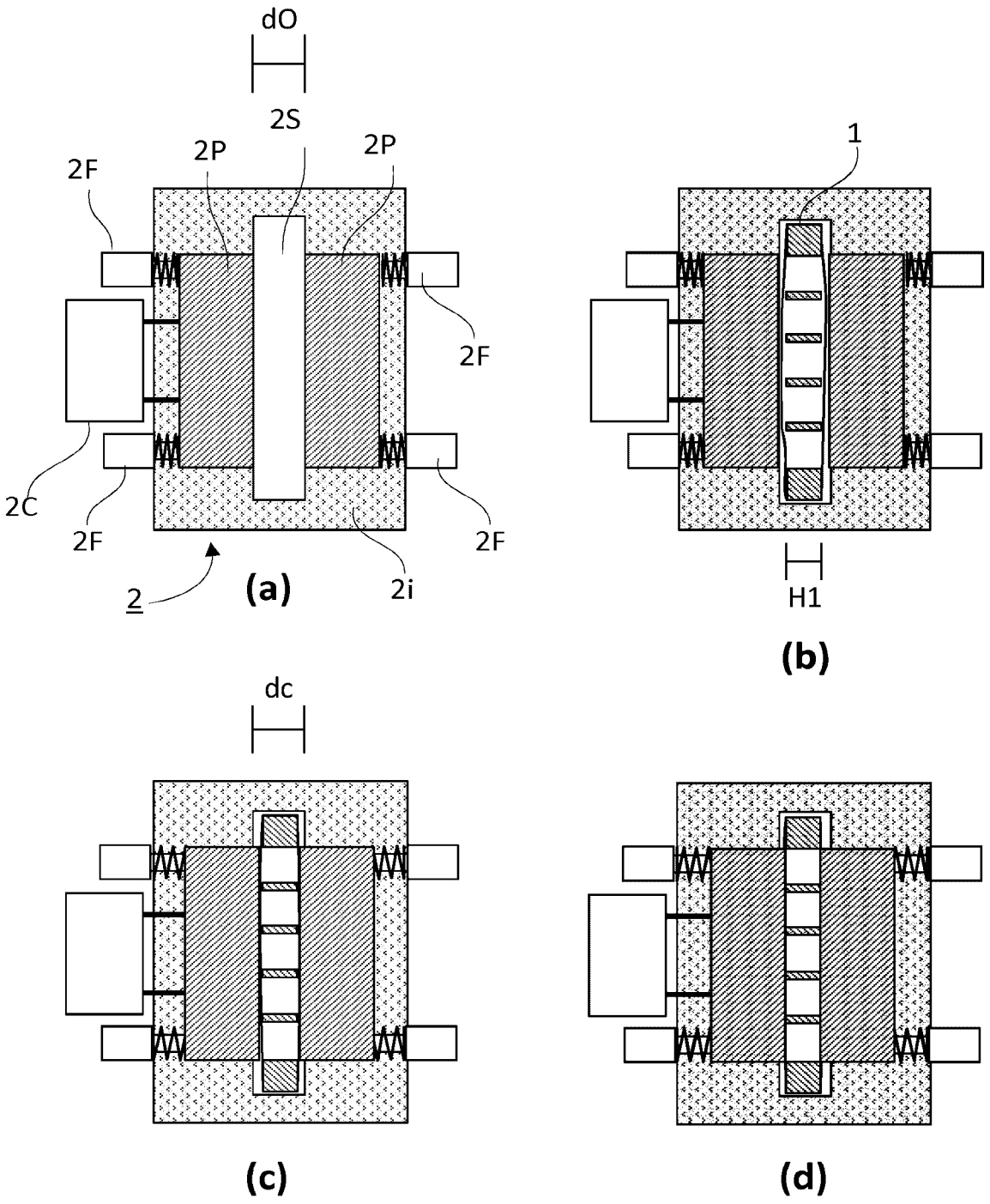
FIG. 4: shows various steps for loading a cooling cartridge into a cooling unit of a first embodiment with (a) the cooling unit with an empty slot ready to receive a cooling cartridge, (b) loading of a cooling cartridge into the slot of the cooling unit, (c) pressurization of the liquid pathway and application of a pressure by moving cooling plates, and (d) pressing of the channel when the container is nearly empty.

As shown in FIGS. 4(*a*) and (*b*), in a loading configuration, the two cooling plates are separated from one another by a loading distance, d0, greater than a thickness of the cartridge and forming an insertion slot (2S). A cartridge (1) can be inserted into said slot as shown in FIG. 4(*b*). When a new cartridge is being inserted, the channel (1C) is generally deflated as the dispensing channel is not yet pressurized at this stage. Upon pressurization of a keg or container after coupling the upstream proximal end (3Up) to the keg, the cartridge channel is inflated (i.e., the foils move apart) and filled with liquid. As shown in FIG. 4(*c*), the cold plates are then allowed to yield to the pressure of the resilient means and the first and second surfaces get closer to one another until they reach a cooling distance, dc, at which they contact the thin films of the cartridge forming the tortuous channel (1C). In a preferred embodiment, the first and second surfaces may comprise a structure mating the surface of the tortuous channel so as to further increase the contact area between the channel and the cooling plates.

As shown in FIG. 4(*d*), when the pressure in the dispensing tube decreases, the flexible channel deflates and the first and second surfaces keep contact with the cartridge foils by getting closer to one another following the volume variations of the flexible channel. The pressure may decrease when the keg is empty or, in some cases, the keg is not constantly pressurized, but only upon dispensing. The advantage of the cooling plates keeping contact with the channel regardless of the volume of the channel is advantageous in that after each dispensing or after a keg got empty; the liquid remaining in the dispensing tube is at least partially pressed out from the channel towards the downstream dispensing tube section to the tapping valve, thus emptying a substantial part of the dispensing tube from any remaining liquid.

Figure 5:
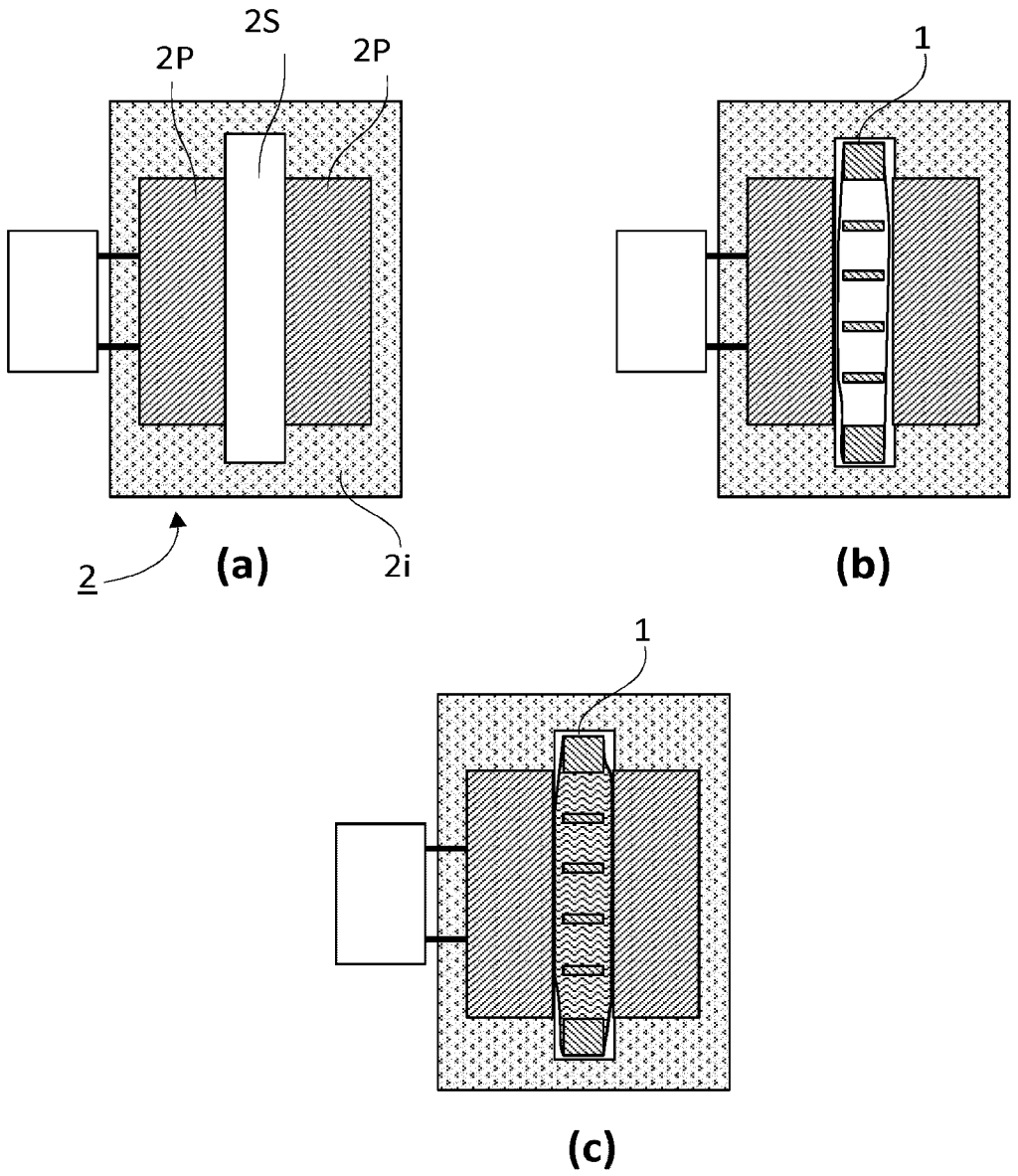
FIG. 5: shows various steps for loading a cooling cartridge into a cooling unit of an alternative embodiment with (a) the cooling unit with an empty slot ready to receive a cooling cartridge, (b) loading of a cooling cartridge into the slot of the cooling unit, and (c) pressurization of the channel and by application of a pressure inside the liquid pathway.

Alternatively, as shown in FIG. 5, the cooling plates are positioned at a fixed distance from one another and the cartridge is inserted in the slot defined by the distance between the cooling plates with the channel non-pressurised. Upon pressurization of a keg or container after coupling the upstream proximal end (3Up) to the keg, the cartridge channel is inflated (i.e., the foils move apart) and are pressed against the cooling plates. Such embodiment allows for the occurrence of short-cuts in the cartridge channel upon pressurisation of the channel due to a moving apart from the foils from the web wall parts.

As shown in FIG. 1(*a*), a cooling unit (2) as defined in the present invention allows dispensing cooled beverages without any chamber for storing one or more containers, be it refrigerated or not. As illustrated in FIG. 1(*b*), a chamber (11) can of course be used to store one or more kegs (5) coupled to a source of pressurized gas (7), but said chamber needs not be refrigerated. The cooling unit can be fixed to a wall of said chamber, which comprises means for passing the downstream dispensing tube section from the inside to the outside of the chamber, to a tapping column and a tapping valve. Besides the fact that a newly coupled keg can be served immediately, without waiting for the whole volume of beverage contained therein to reach the serving temperature, the present invention also allows a reduction of the investment required for home and pubs appliances alike, since no cooling chamber is required for serving a chilled beverage. FIG. 1(*c*) illustrates a cooling unit as defined in the present invention in a typical home appliance setup. As discussed above, a cartridge can be very cheap and cooling becomes very easy and economical with the present invention.

FIG. 7 illustrates a three alternatives of a cooling unit (2) as defined in the present invention in a dispensing apparatus suited for dispensing a beverage starting from a concentrated beverage component, such as a concentrated beer or cider, a diluent and potentially, a source of compressed gas (e.g., carbon dioxide, nitrogen or a mixture of both). In such dispensing apparatus it is preferred that the cooling unit is positioned in a dispense line section connecting a keg or reservoir (5) with diluent (e.g., water or a neutral beer base) with a source of pressurized gas or carbonation unit (7) as carbonation of the diluent can be performed more efficiently at sub room temperature. The carbonation unit is preferably positioned downstream a mixing unit (10 M) wherein a concentrated beverage component is mixed with the pre-carbonated diluent. Alternatively, the cooling unit can be positioned in any other of the dispense line sections. However, it is preferred to cool the diluent or final beverage as the diluent represents the largest volume fraction of the final beverage. Positioning the cooling unit in a dispense line section of the diluent downstream the mixing unit is also advantageous when the diluent is water, for the reason that water is less prone to biological spoilage than the mixed beverage, especially in the case of beer.

In use, all the components described supra are assembled to form a beverage dispensing apparatus comprising a container/keg/reservoir containing a beverage or beverage component, and further comprising:

(A) A cartridge (1) as defined supra, with (B) A beverage dispensing appliance provided with a cooling unit as defined supra, i.e., comprising two cooling plates separated by a slot (2S) for receiving a cartridge. The dispensing appliance preferably but not necessarily comprises a chamber (11) for storing one or more beverage containers and potentially at least one source of pressurized gas.

The cartridge is inserted in the insertion slot (2S) of the cooling unit (2). A continuous dispensing tube runs from the upstream proximal end (3Up) in fluid communication with the interior of the container to the downstream distal end (3Dd) coupled to the tapping valve and opening to the ambient atmosphere. The beverage being dispensed is cooled as it flows through the tortuous channel of the cartridge by exchanging heat with the first and second surfaces of the first and second cooling plates in intimate thermal contact with the thin walls of the channel. A cold or chilled beverage can thus be served without having to cool the whole content of the container.

Clearly a beverage dispensing appliance may comprise more than one cooling units according to the present invention, the different cooling units cooperating with a single dispense line between a beverage or beverage component reservoir and a tap valve or cooperating with multiple dispense lines each coupling a beverage reservoir or beverage component reservoir with a dedicated beverage tap, allowing dispensing more than one beverage from the appliance, whereby each beverage is dispensed through a different dispense line and each of the dispense lines cooperate with a dedicated cooling unit (as such allowing dispensing the different beverages each at its own preferred temperature).

The invention claimed is:

1. A cooling unit comprises:

(a) a cooling cartridge having:

(I) two foils sealed to one another along a perimeter area delimiting an inner area of the cartridge where a liquid pathway is defined between both foils, the liquid pathway making a fluid communication between an inlet and an outlet of the cooling cartridge;

(ii) a web or mesh of material provided between both foils in the inner area of the cooling cartridge in the liquid pathway, the web or mesh of material comprising contact zones configured to contact the foils of the cooling cartridge when the pressure reigning in the inner area equals ambient pressure;

(b) a first cooling plate comprising a first surface and a second cooling plate comprising a second surface facing the first surface; and (c) a cold source suitable for cooling said first and second surfaces, wherein the inner area of the cooling cartridge is positioned between both cooling surfaces; wherein the foils are not or only at distinct locations attached to the contact zones of the web or mesh material.

2. The cooling unit according to claim 1, the web or mesh of material disposed between both foils defining a non-rectilinear trajectory to the liquid pathway.

3. A cooling unit according to claim 1, the web or mesh of material disposed between both foils comprising a perimeter wall defining the perimeter of the cooling cartridge with both foils sealed to the perimeter wall, the web or mesh extending in the inner area defining a non-rectilinear trajectory of the liquid pathway between the foils.

4. The cooling unit according to claim 3, wherein the part of the foils situated in the inner area is stretchable or has dimensions larger than the inner area, such as to allow that the foils are at least locally spaced apart from the wall parts in a direction perpendicular to the cooling surfaces when the inner volume of the liquid line is pressurized, thereby creating short-cuts in the trajectory of the liquid pathway.

5. The cooling unit according to claim 1, wherein the distance separating the first surface and second surface of the first and second cooling plates can be varied, from a loading distance, dO greater than a thickness H1 of the cooling cartridge and forming an insertion slot allowing the introduction of the cartridge between the two cooling plates, and to a cooling distance, dc<dO, wherein the first and second surfaces contact the first and second foils and press these foils against the wall parts of the web or mesh.

6. The cooling unit according to claim 5, wherein at a distance dc, the cooling plates press the foils against the contact zones of the web or mesh of material.

7. The cooling unit according to claim 1, comprising baffles or turbulence inducing elements in the non-rectilinear trajectory of the liquid pathway.

8. The cooling unit according to claim 1, wherein at least one of the foils manufactured in a metallic material, preferably aluminium or a metalized polymeric material.

9. The cooling unit claim 1, wherein the web or mesh of material being manufactured in a polymeric material, a metallic material or a metallic/polymeric hybrid material.

10. The cooling unit according to claim 1, wherein the web of material comprises wall parts defining the contact zones between the web and the foils, said contact zones of the web having a thickness, measured perpendicular to the height direction, of 2 mm or less, preferably 1 mm or less.

11. A beverage dispensing apparatus comprising a cooling unit as identified in claim 1.

12. The beverage dispensing apparatus according to claim 11, comprising a source of a concentrated beverage component fluidly connected to a dispense tap by a first dispense line and a source of a diluent fluidly connected to the dispense tap by a second dispense line, the cooling unit integrated in the apparatus for cooling the concentrated beverage component and/or diluent when flowing to the first and/or second dispense line.

13. The beverage dispensing apparatus according to claim 11, comprising a mixing unit having an inlet in fluid communication with the first and second dispense lines and an outlet in fluid communication with the dispense tap, the cooling unit integrated in the apparatus for cooling the concentrated beverage component and/or diluent downstream the mixing unit.

14. The beverage dispensing apparatus according to claim 11, comprising a carbonation unit, preferably an in-line carbonation unit, having an inlet in fluid communication with the source of diluent and an outlet in fluid communication with the dispense tap, the cooling unit integrated in the apparatus for cooling the diluent downstream the carbonation unit.

15. A kit of parts for a beverage dispensing apparatus comprises:

(a) a cooling cartridge having:

(I) two foils sealed to one another along a perimeter area delimiting an inner area of the cartridge where a liquid pathway is defined between both foils, the liquid pathway making a fluid communication between an inlet and an outlet of the cooling cartridge;

(ii) a web or mesh of material provided between both foils in the inner area of the cooling cartridge in the liquid pathway, the web or mesh of material comprising contact zones where the foils contact the web or mesh of material in the inner area of the cooling cartridge when the pressure reigning in the inner area equals ambient pressure; and (b) a beverage dispensing appliance comprising a cooling unit having:

(I) a first cooling plate comprising a first surface and a second cooling plate comprising a second surface facing the first surface;

(ii) a cold source suitable for cooling said first and second surfaces, wherein the liquid line is positioned between both cooling surfaces;

wherein the foils of the cooling cartridge are not or only at distinct locations attached to the contact zones of the web or mesh of material.

16. A cooling unit comprises:

(a) a cooling cartridge having:

(I) two foils sealed to one another along a perimeter area delimiting an inner area of the cartridge where a liquid pathway is defined between both foils, the liquid pathway making a fluid communication between an inlet and an outlet of the cooling cartridge;

(ii) a web or mesh of material provided between both foils in the inner area of the cooling cartridge in the liquid pathway, the web or mesh of material comprising contact zones configured to contact the foils of the cooling cartridge when the pressure reigning in the inner area equals ambient pressure;

(b) a first cooling plate comprising a first surface and a second cooling plate comprising a second surface facing the first surface; and (c) a cold source suitable for cooling said first and second surfaces, wherein the inner area of the cooling cartridge is positioned between both cooling surfaces; wherein the foils are not or only at distinct locations attached to the contact zones of the web or mesh material, the web or mesh of material disposed between both foils comprising a perimeter wall defining the perimeter of the cooling cartridge with both foils sealed to the perimeter wall, the web or mesh extending in the inner area defining a non-rectilinear trajectory of the liquid pathway between the foils, wherein the part of the foils situated in the inner area is stretchable or has dimensions larger than the inner area, such as to allow that the foils are at least locally spaced apart from the wall parts in a direction perpendicular to the cooling surfaces when the inner volume of the liquid line is pressurized, thereby creating short-cuts in the trajectory of the liquid pathway.

* * * * *